US005320142A

United States Patent [19]

Sainen

[11] Patent Number: 5,320,142

[45] Date of Patent: Jun. 14, 1994

[54] METHOD AND APPARATUS FOR CONTROLLING AN ACTUATOR FOR WEFT INSERTING IN A JET LOOM

[75] Inventor: Tsutomu Sainen, Ishikawa, Japan

[73] Assignee: Tsudakoma Kogyo Kabushiki Kaisha, Ishikawa, Japan

[21] Appl. No.: 909,629

[22] Filed: Jul. 7, 1992

[30] Foreign Application Priority Data

Jul. 9, 1991 [JP] Japan ..... 3-193566

[51] Int. Cl.[5] ..... D03D 47/30

[52] U.S. Cl. ..... 139/435.2; 139/1 R; 364/470; 364/921.1

[58] Field of Search ..... 364/470, 921.1; 395/50; 139/435.2, 1 R

[56] References Cited

U.S. PATENT DOCUMENTS 4,458,726 7/1984 Wenig .
4,830,063 5/1989 Takegawa ..... 139/435.2
4,967,806 11/1990 Imamura et al. .
5,115,840 5/1992 Yamada ..... 139/435.2

FOREIGN PATENT DOCUMENTS 0382490 2/1990 European Pat. Off. ..... 139/1 R
61-34257 2/1986 Japan .
63-75149 4/1988 Japan .
63-92754 4/1988 Japan .
109534 7/1989 Taiwan .

*Primary Examiner*—Andrew M. Falik
*Attorney, Agent, or Firm*—Graybeal Jackson Haley & Johnson

[57] ABSTRACT

A method and an apparatus for controlling weft inserting without depending on any operation skill, such control being on the basis of at least two kinds of information having mutually different frequencies for correcting weft inserting. A plurality of control rules prepared according to control algorithms, a plurality of data tables for weft inserting prepared according to the control algorithms or approximate expressions are used for calculating the control conditions of an actuator for weft inserting, and the weft inserting actuator is controlled on the basis of the calculated control conditions.

8 Claims, 4 Drawing Sheets

FIG. 4(A)

| y | s | Δμk0 | Δσk0 | Δμt0 | Δσt0 |
|---|---|---|---|---|---|
| 4 | | −4 | −2 | −4 | −2 |
| 2 | | −2 | −1 | −2 | −1 |
| 0 | 4 | 4 | 2 | 4 | 2 |
| 0 | 2 | 2 | 1 | 2 | 1 |
| 0 | 0 | 0 | 0 | 0 | 0 |

FIG. 4(B)

| μk−μk0 | σk−σk0 | μt−μt0 | σt−σt0 | ΔM |
|---|---|---|---|---|
| : | : | : | : | : |
| 5 | −5 | −5 | −5 | +0.5 |
| : | : | : | : | : |
| −5 | 5 | −5 | −5 | +0.5 |
| : | : | : | : | : |
| −5 | −5 | 5 | 5 | +0.3 |
| −5 | −5 | 5 | 0 | +0.2 |
| −5 | −5 | 5 | −5 | +0.1 |
| −5 | −5 | 0 | 5 | +0.1 |
| −5 | −5 | 0 | 0 | 0.0 |
| −5 | −5 | 0 | −5 | −0.1 |
| −5 | −5 | −5 | 5 | 0.1 |
| −5 | −5 | −5 | 0 | −0.3 |
| −5 | −5 | −5 | −5 | −0.5 |

METHOD AND APPARATUS FOR CONTROLLING AN ACTUATOR FOR WEFT INSERTING IN A JET LOOM

BACKGROUND OF THE INVENTION

1. Field of the Invention

This invention relates to a method and an apparatus for controlling weft inserting in an air jet loom, a water jet loom or the like, and more particularly, to a method and an apparatus for controlling weft inserting in a jet loom provided with an actuator for weft inserting.

2. Description of the Prior Art

There has been proposed such a technique for controlling weft inserting so as to make fabrics get the predetermined qualities by correcting control conditions, that is, control parameter such as a pressure of the fluid jetted from a main nozzle (designated as "main pressure" in the present invention) or a pressure jetted from a subnozzle (designated as "subpressure" in the present invention) and then controlling actuators thereof on the basis of either one of running information such as the rotational angle (arrival angle) of a main shaft when a weft inserted into a warp shed reaches the predetermined position, the stopping machine information such as the causes for stopping the weaving machine and the stop frequency thereof and quality information such as slack filling in woven fabrics and the frequency thereof.

Now, the correction of the control conditions due to the running information is practiced in a short period (one period as the shortest cycle) during the operation of the weaving machine. On the other hand, since the correction of the control conditions due to the stopping machine information or quality information is practicable only when the weaving machine happens to be stopped or when the product quality is lowered, these corrections are practiced in longer period. The directions to be corrected may sometimes be different depending on the running information, the stopping machine information and the quality information.

Consequently, even though the corrections of the control conditions based on such a plurality of kinds of information may be employed simultaneously, the corrections due to these kinds of information are mutually cancelled and the corrections due to these information cannot be made use of altogether. In other words, for example, even though the control conditions may be corrected on the basis of the stopping machine information after a stop of the weaving machine, the control conditions are thereafter returned to the control conditions before a stop of the weaving machine by the correction of the control conditions on the basis of the running information under the operation of the weaving machine.

As described above, the techniques known per se only correct the control conditions using a single information selected from the group consisting of the running information, the stopping machine information and the quality information, as disclosed in Japanese Patent Public Disclosure (KOKAI) Nos. 56-107046 and 63-75149. Therefore, since the control conditions could not be corrected by using a plurality of kinds of information, the correction of the control conditions by using a plurality of kinds of information is performed manually by operator skill without relying on any automatic corrections.

SUMMARY OF THE INVENTION

It is an object of the present invention to allow the weft inserting to be automatically controlled on the basis of a plurality of kinds of information without relying on the operator's professional feelings and experiences.

A method for controlling weft inserting in the present invention comprises the steps of obtaining the control condition of an actuator for weft inserting on the basis of at least two kinds of information including running information representing the running state of weft, and stopping machine information representing the stopping state of a weaving machine or quality information representing the quality of a fabric quality, by use of at least one means selected out of the following means: a) an expert system constituted according to a control algorithm for weft inserting, b) a data table having data for weft inserting composed of a control algorithm for weft inserting, and c) an approximate expression calculated by use of at least two kinds of information; and controlling the preceding actuator on the basis of the control condition thus obtained.

An apparatus for controlling weft inserting in the invention comprises: generation of at least two kinds of information including running information representing the running state of weft, and stopping machine information representing the stopping state of a weaving machine or quality information representing the quality state of woven fabric; generating condition control from means selected from the grouping consisting of a) an expert system composed of a control algorithm for weft inserting and for obtaining a control condition of an actuator for weft inserting on the basis of the informations, b) a data table having data for weft inserting and composed of a control algorithm for weft inserting and for obtaining a control condition of the actuator for weft inserting on the basis of preceding, stored data; and c) memory storage providing a plurality of approximate expressions for calculating a control condition of the actuator for weft inserting using the informations, and for obtaining the preceding control condition using the preceding information and the preceding approximate expression; and actuator control based on the obtained control condition.

In the following discussion setting forth examples of practice of the present invention, the term "blow-by" refers to a trouble caused by a state where the leading end of a weft is cut and the cut portion is blown by weft inserting fluid. The term "barrel slipping" means a trouble caused by a state where a weft is cut at an intermediate portion and the intermediate portion is missing, and the term "leading end trouble" refers to all troubles in the leading end of a weft caused, for example, when the leading end jams with a warp. Also, the terms "control algorithm" and "control algorithms" as used herein refer to control rules or steps to solve the problem of controlling weft inserting.

For an example of practice of the invention, in case where a control object is the main pressure, (i.e. the pressure of fluid jetting from the main nozzle for weft inserting, more particularly the pressure resulting from control of the pressure regulator, e.g. regulator 38, as discussed below), the control algorithm is composed of at least two kinds of information including running information with either stopping machine information or quality information in the following manner:

"Increase the main pressure, when the slack fillings often happen irrespective of leading end troubles, blow-by at the leading ends, barrel slippings, an average value and a dispersion of final release timing, and an average value and a dispersion of arrival timing,";

"Do not change the main pressure when no slack filling happens, but when leading end troubles, blow-by at the leading ends and barrel slippings often happen and when the slack fillings have ever happened."

"Decrease the main pressure, when no slack filling happens but when leading end troubles, blow-by at the leading ends and barrel slippings often happen, and when no slack fillings have ever happened irrespective of leading end troubles, blow-by at the leading ends, barrel slipping, an average value and a dispersion of final release timing, and an average value and a dispersion of arrival timing."

The expert system obtains the control condition on the basis of a plurality of control rules using at least two kinds of information including running information with either stopping machine information or quality information, for example, in the following manner:

"Increase the main pressure by P, when a present slack filling frequency is often".

"Do not change the main pressure, when no slack filling happens, even though when leading end troubles, blow-by at the leading ends and barrel slipping often happen and when the slack fillings happened before" and "Decrease the main pressure by p, when no slack filling happens, when leading end troubles, blow-by at the leading ends and barrel slippings often happen and when no slack filling happened before." In this case, the p may be a value for actually altering the pressure, a value for altering an objective value of the pressure, a value in common to the control rules or a different value every each control rule.

The control condition obtained from the control condition-generating means is supplied to control means such as a pressure controller and the control means controls an actuator such as a pressure regulator on the basis of the supplied control condition.

According to the control method and the control apparatus which employ the expert system as the control condition-generating means, weft inserting can be controlled by using not only the running information under operation but also the stopping machine information or the quality information, and the weft inserting can be done under the conditions satisfactory to these kinds of information.

In case of using the operating means provided with the data table as the control condition-generating means, the operating means stores, for example, data such as a corrected content of the control object such as a main pressure or a corrected content of an objective value of the control object in the data table, for each combination of the running information with either the stopping machine information or the quality information. The operating data storage reads out the data of an address corresponding to the combination of the running information with either the stopping machine information or the quality information from the data table, and obtains a control condition on the basis of the read-out data. In this case, the data may be a value for actually altering the control condition such as a pressure, or a value for altering an objective value of the control condition. In any of the cases, the data is a value corresponding to the combination of these kinds of information.

Weft inserting can be controlled by use of not only any running information under operation but also any stopping machine information or any quality information even by the control method and the control apparatus which utilize the operating means provided with the preceding data table as the control condition-generating means, and the weft inserting can also be done under the satisfactory condition to these kinds of information.

For example, some weaving machines are actually operated skillfully to obtain the data such as the running information, the stopping machine information or the quality information, and the control condition for the actuator at that time. Then, the approximate expressions can be obtained from these data by a double regression analysis, for example. The approximate expressions thus obtained approximate the control algorithms realized by the skillful operators.

According to the control method and the control apparatus which employ the approximate expressions, weft inserting can also be controlled by using not only the running information under operation but also the stopping machine information or the quality information, and the weft inserting can be done under the satisfactory condition to these kinds of information.

BRIEF DESCRIPTION OF THE DRAWING

The foregoing and objects and features of the invention will become apparent from the following description of preferred embodiments of the invention with reference to the accompanying drawings, in which:

FIGS. 4(A) and 4(B) are tables showing data used in the weft inserting control apparatus of FIG. 3 as a preferred embodiment of the present invention.

DETAILED DESCRIPTION OF THE PREFERRED EMBODIMENTS

Figure 1:
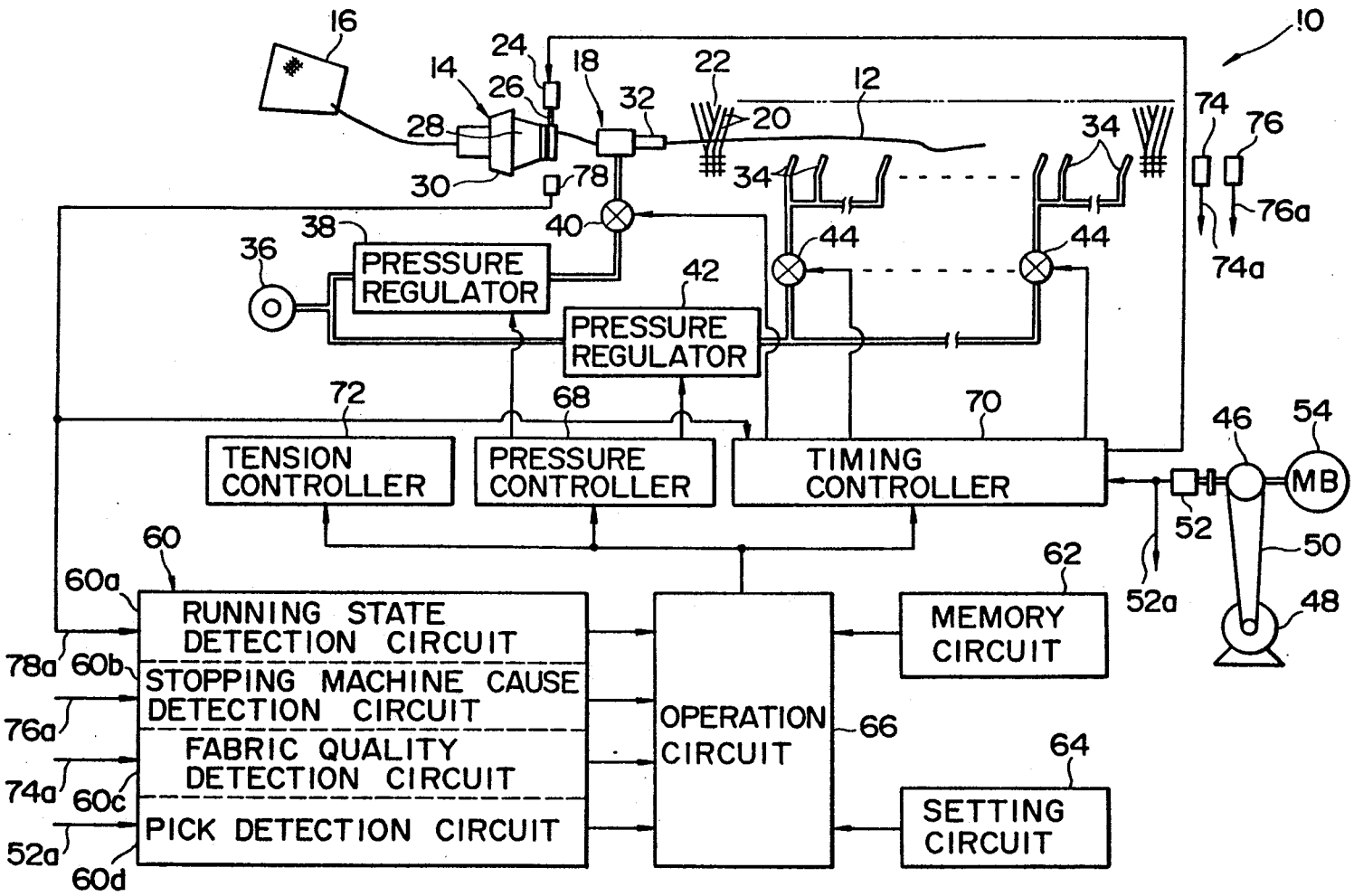
FIG. 1 is a block diagram showing an electric circuit of a weaving machine provided with a weft inserting control apparatus as a preferred embodiment of the present invention;.

Referring now to FIG. 1, a weaving machine 10 is a jet loom of either an air or water type, and includes a drum type length measuring storage unit 14 for a weft 12. The weft 12 is rolled around a weft package 16. The weft 12 is also supplied from the weft package 16 to a weft inserting unit 18 known per se through the length measuring storage unit 14 and is inserted in a warp shed 22 from the preceding weft inserting unit.

At the measurement time, the weft 12 is prevented from the release from a length measuring-and-storage drum 28 by an engagement pin 26 operated by an electromagnetic solenoid 24, and is stored while being rolled by a predetermined length around the circumferential surface of the drum 28 through the rotation of a yarn guide 30.

On the other hand, at the weft inserting time, the weft 12 is released from the drum 28 by the release of the pin 26, and is cut off after the weft 12 is ejected from a main nozzle 32 of the weft inserting unit 18 together with fluid so as to be inserted into the warp shed 22. The weft inserting unit 18 includes a plurality of subnozzles 34 for jetting the fluid to advance the weft 12 to a predetermined direction at the weft inserting time.

Working fluid of a pressure source 36 is supplied to the main nozzle 32 through a pressure regulator 38 and a switching valve 40. On the other hand, the working fluid of the pressure source 36 is supplied to each subnozzle 34 through a pressure regulator 42 and a corresponded switching valve 44.

The weaving machine 10 also includes a motor 48 for a main shaft 46 for driving a reed. The rotation of the motor 48 is transmitted from a connection mechanism 50 to the main shaft 46. The main shaft 46 is attached with both an encoder 52 for generating a rotational angle signal corresponding to the rotational angle of the main shaft and an electromagnetic brake 54 for the main shaft 46. The length measuring storage unit 14 and the weft inserting unit 18 are driven together with healds and reed in synchronism with the rotation of the main shaft 46.

A weft inserting control apparatus for the weaving machine 10 includes a detection circuit 60 for detecting operating information with respect to the weft inserting of the weaving machine, a memory circuit 62 for storing various information, data or the like, a setting circuit 64 for manually setting various information, an operation circuit 66 for obtaining a control condition on the basis of the information and data from each of the preceding circuits 60 through 64, a pressure controller 68 for controlling the pressure regulators 38 and 42 on the basis of the signal supplied from the operation circuit 66, a timing controller 70 for driving the switching valves 40 and 44 and the electromagnetic solenoid 24 on the basis of the signal supplied from the operation circuit 66, and a tension controller 72 for controlling a warp tension mechanism (not shown) on the basis of the signal supplied from the operation circuit 66.

The operating information includes running information, stopping machine information, quality information and a pick number. Therefore, the respective output signals 74*a*, 76*a*, 78*a* and 52*a* of a first detector 74 for detecting that the weft 12 is inserted up to a final position thereof, a second detector 76 for detecting that the weft 12 is inserted up to not less than a permissible position thereof, a release sensor 78 for detecting that the weft 12 is released from the length measuring storage unit 14 and an encoder 52 are supplied to the detection circuit 60. The output signal 78*a* of the release sensor 78 is also supplied to the timing controller 70.

The detection circuit 60 is provided with a circuit 60*a* for detecting the weft running state, a circuit 60*b* for detecting the cause of the stopping of the weaving machine, a circuit 60*c* for detecting a fabric quality and a circuit 60*d* for detecting picks or the like.

As for the running information, for example, use is made of an average value and a dispersion of weft running timing such as so-called release timing like a rotational angle (release angle) of the main shaft when the weft at a predetermined number of turns of the weft around the drum 28 is released from the length measuring storage unit and so-called arrival timing like a rotational angle (arrival angle) of the main shaft when a leading end portion of the weft reaches a predetermined position.

As for the running timing, at least one selected from the following group can be used, that is:

so-called "final release timing" such as rotational angle of the main shaft when the final roll of the weft is released from the length measuring storage unit;

so-called "final arrival timing" such as a rotational angle of the main shaft when leading end portion of the weft reaches the final position; and so-called "intermediate arrival timing" such as a rotational angle of the main shaft when the weft reaches a predetermined position between the length measuring storage unit and the final position.

As for a specific value of an average value of the running timing, for example, at least one selected from the following group can be used, that is:

an average value itself of running timing;

a difference between an average value of running timing and an objective value thereof, that is, an average value error;

an average value itself of the maximum or minimum value in running timing; and a difference between an average value of the maximum or minimum value in running timing and an objective value thereof.

As for a specific value of a dispersion of the running timing, for example, at least one selected from the following group can be used, that is:

a dispersion itself of running timing;

a difference between a dispersion of running timing and an objective value thereof, that is, a dispersion error;

a dispersion itself of the maximum or minimum value in running timing; and a difference between a dispersion of the maximum or minimum value in running timing and an objective value thereof.

The stopping machine information is the frequency of each cause of machine stoppage. As for a stopping machine cause, there are a so-called "H1 stop" due to the fact that the weft 12 cannot be detected by the first detector 74 and a so-called "H2 stop" due to the fact that the weft 12 can be detected by the second detector 76.

As for the causes for an H1 stop and an H2 stop, for example, the following are listed.

H1 stop:
leading end troubles
Vent pick
Warp looping
Length measuring mistake
Blow-by at the leading ends
Cutting mistake
Stop by running out
H2 Stop:
Barrel slipping
Run out of constraint As for the quality information, the following will be listed.

Slack filling
Kinky thread
fluff

In a case where there are sensors automatically detecting individual phenomenon, the stopping machine information and the quality information can, however, be obtained by the input of these signals, and in a case where these sensors are not available, the preceding information can be obtained by manual input on the basis of the operator's judgment. Furthermore, the quality information is inputted depending on the sensor or the operator's judgment during the operation of the weaving machine or after the machine stops.

As for the control conditions, that is, control parameters, for example, at least one selected from the following group can be used, that is:

Main pressure;

Subpressure;

Timing at the start of a fluid ejection from the main nozzle;

Timing at the end of a fluid ejection from the main nozzle;

Timing at the start of a fluid ejection from the subnozzle;

Timing at the end of a fluid ejection from the subnozzle;

Timing at the start of a weft release by the length measuring storage unit;

Timing at the end of a weft release by the length measuring storage unit; and

Start time for weft inserting, that is, start time for weft picking. Now, the start time for weft inserting means what is defined by both the timing at the start of a fluid ejection from the main nozzle and the timing at the start of a weft release from the length measuring storage unit, and is always a parameter when the start time for weft inserting is set so that both of such timings may be altered interlockingly.

The kinds of threads, the representative values (average value, median, mode, fastest value, latest value or the like) of the objective values in the control parameters, the dispersion (standared deviation, range or the like) of the objective values in the control parameters, the sample number (pick number, woven length, time) and the upper or lower limit value of operation content are all set in the setter 64.

Any of the corrected values of a plurality of control rules and the control conditions and the approximate expressions are stored in the memory circuit 62, depending on selecting either of the expert system, the data table or the approximate expressions for the control conditions. The corrected values of a plurality of control rules and the control conditions are prepared according to a predetermined control algorithm. On the other hand, the approximate expressions are obtained by causing the weaving machine to be actually operated by a skillful operator to give data for the running information, stopping machine information or quality information, the control conditions for the actuator or the like at that time, and then making a double regression analysis from the preceding data.

As described in prior art, however, various automatic control systems on the basis of the running information are generally attached to the weaving machine as the control during the operation of the weaving machine. For example, as for the automatic control system, there are some systems for automatically varying the pressure and/or the jet timing so that an angle for weft to reach a weft sensor provided at a predetermined position in the weft inserting path may become constant. If an automatic control system on the basis of the stopping machine information or the quality information made after the weaving machine stops is merely added to this automatic control system, both of these automatic control systems interfere with each other and the functions thereof cannot be activated together.

In the present invention, now, this problem has been solved by the following two techniques, respectively.

(1) The automatic control system on the basis of the running information is combined with the automatic control system on the basis of the stopping machine information to prepare a control algorithm in which the running information, the stopping machine information and the quality information are combined with one another, and according to this control algorithm, the control conditions of a pressure, timing or the like are varied.

(2) The automatic control system on the basis of the running information is worked as it is, and the control algorithm on the basis of the stopping machine information and the quality information does not vary the control conditions of the pressure or the like, but corrects an objective value to be used in the automatic control system on the basis of the running information.

According to the above description (1), any control conditions are corrected on the basis of the combined control algorithm with the running information, the stopping machine information and the quality information, and consequently, a control can be performed under a condition satisfactory to each kind of information.

According to the above description (2), the objective value to be used in the existing automatic control system on the basis of the running information while using this automatic control system as it is, is corrected by the automatic control system on the basis of the stopping machine information and the quality information, and consequently, a control is performed under a condition satisfactory to each kind of information without any mutual interferences in the automatic control systems.

The following will show one embodiment of the control algorithm on the basis of the above description (1). As used herein, the term "algorithm" means a set of rules or steps to solve problems and, with respect to the present invention, the term "control algorithms for weft inserting" means algorithms used for controlling weft inserting. Also, as used herein, the term "blow-by" means a trouble caused by an operating state where the leading end of a weft is cut and the cut portion is blown by the weft inserting fluid, the term "barrel slipping" means a trouble caused by an operating state where a weft is cut at an intermediate portion with the result that the portion is missing, and the term "leading end trouble " means all troubles in the leading end of a weft caused, for example, when the leading end jams with a warp. In addition, the following control algorithm is available for the case where the control condition is a main pressure, but it may be in other control conditions in the above description or in combinations thereof.

A1: Increase the main pressure, independently of any leading end troubles, when there are slack fillings a blow-by at the leading ends, a barrel slipping, an average value and a dispersion of final release timing and an average value and a dispersion of arrival timing.

A2: Do not change the main pressure, when there is no slack filling, and any leading end troubles, blow-by at the leading ends and barrel slippings often happen and when the slack fillings have ever happened.

A3: Decrease the main pressure, independently of an average value and a dispersion of final release timing and an average value and a dispersion of arrival timing, when there is no slack filling, any leading end troubles, blow-by at the leading ends and barrel slippings often happen and there was no slack filling before.

A4: Do not change the main pressure, when there is no slack filling, and any leading end troubles, blow-by at the leading ends and barrel slippings happen a little, but when there were slack fillings before or any leading end troubles, blow-by at the leading ends and barrel slippings did not happen before.

A5: Increase the main pressure, when there is no slack filling, and any leading end troubles, blow-by at the leading ends and barrel slippings happen a little, but when there was no slack filling before, any leading end troubles, blow-by at the leading ends and barrel slippings happened a little before and an average value of final release timing is late or a dispersion thereof is large.

A6: Increase the main pressure, when there is and was no slack filling and any leading end troubles, blow-by at the leading ends and barrel slippings happen a little and happened a little before, but when an average value of final release timing is fast, a dispersion of final release timing is small, an average value of arrival timing is late and a dispersion of arrival timing is large.

A7: Increase the main pressure, when there is and was no slack filling and any leading end troubles, blow-by at the leading ends and barrel slippings happen a little and happened a little before, but when an average value of final release timing is fast, a dispersion of final release timing is small, an average value of arrival timing is delayed and a dispersion of arrival timing is small.

A8: Do not change the main pressure, when there is and was no slack filling and any leading end troubles, blow-by at the leading ends and barrel slippings happen a little and happened a little before, but when an average value of final release timing is fast, a dispersion of final release timing is small, an average value of arrival timing is fast and a dispersion of arrival timing is large.

A9: Decrease the main pressure, when there has been no slack filling and when little leading end troubles, and blow-by at the leading ends and barrel slippings have ever happened, but when an average value of final release timing is fast, a dispersion of final release timing is small, an average value of arrival timing is fast and a dispersion of arrival timing is small.

In the control algorithm as described above, since the slack fillings are problem related to fabric quality, the control condition is corrected if a slack filling happens even only once. On the other hand, in case of leading end troubles, blow-by at the leading ends and barrel slippings, the control condition is corrected depending on the generation frequencies thereof. It can be judged by comparing the generation ratios between the generation times during a certain period of time (hour, pick number and woven length) and each stopping machine cause to the total stopping machine times during the certain period of time with the limiting values thereof whether the frequencies are "often" or "small". The words "before" and "have ever" can mean an arbitrary time in the past, and for example, it can be set as a measure of the time while a piece of weft package is consumed. Furthermore, the definitions such as "small", "large", "fast", and "late" can be standardized using the corresponding objective values and limiting values.

Now, on the basis of the above description (2), one embodiment of the control algorithm for correcting actual control information by correcting the objective values of the control conditions will be shown in the following. This is an embodiment when the automatic control system on the basis of the running information controls the main pressure so that the running timing of a weft may be arranged within an objective value. The parentheses show the corrected state of the resulting main pressure.

A10: Quicken the objective value in the average value of arrival timing. (Increase the main pressure), when there were slack fillings.

A11: Delay the objective values in the average values of final release timing and arrival timing and enlarge the objective values of both dispersion (Decrease the main pressure.), when any leading end troubles often happen.

A12: Delay the objective values in the average values of final release timing and arrival timing and enlarge the objective values of both dispersions (Decrease the main pressure.), when any blow-by at the leading ends often happens.

A13: Delay the objective values in the average values of final release timing and arrival timing and enlarge the objective values of both dispersions (Decrease the main pressure.), when any barrel slippings often happen.

The control algorithm as described above can also be prepared with respect to the preceding other control conditions, and it may be prepared using other information as well.

In case where the weft inserting control apparatus uses the expert system, a plurality of control rules prepared according to the preceding control algorithm are stored in the memory circuit 62. On the other hand, in case where the weft inserting control apparatus uses the data table, a plurality of data for weft inserting prepared according to the preceding control algorithm are stored in the memory circuit. Furthermore, in case where the weft inserting control apparatus uses the approximate expression, the approximate expression is stored in the memory circuit 62.

Now, a specific method for controlling weft inserting will be explained in the following. The following explanation relates to the case of controlling the main pressure, but it can also control the case by other control conditions such as the subpressure, action timing of the engagement pin or the like in a similar manner. Other information may be used as well.

First of all, referring now to FIG. 1, the detailed description of a control method of the main pressure by the approximate expression will be given in the following. The following approximate expression for obtaining a corrected value of the main pressure is stored in the memory circuit 62.

$$\Delta M = f(\mu k - \mu k0,\ \sigma k - \sigma k0,\ \mu t - \mu t0,\ \sigma t - t0,\ y,\ s)$$

wherein, $\mu k$: an average value of final release timing, $\sigma k$: a dispersion of final release timing, $\mu t$: an average value of arrival timing, $\sigma t$: a dispersion of arrival timing, $\mu k0$: an objective value in the average value of final release timing, $\sigma k0$: an objective value in the dispersion of final release timing, $\mu t0$: an objective value in the average value of arrival timing, $\sigma t0$: an objective value in the dispersion of arrival timing, y: a frequency of present slack filling, $\Delta M$: a corrected value for main pressure, and s: a ratio of total stopping machine frequencies due to leading end troubles, blow-by at the leading ends and barrel slippings to total stopping machine frequencies.

The preceding approximate expression can be obtained by actually operating the weaving machine, experimentally recording each value of input variables at that time and the corrected content by a skillful operator, and making a double regression analysis using these values.

The objective value $\mu k0$ in the average value of final release timing, the objective value $\sigma k0$ in the dispersion of final release timing, the objective value $\mu t0$ in the average value of arrival timing, and the objective value $\sigma t0$ in the dispersion of arrival timing are preliminarily set in the setting circuit 64, respectively.

The operation circuit 66 calculates the average value $\mu k$ and the dispersion $\sigma k$ of final release timing and the average value $\mu t$ and the dispersion $\sigma t$ of arrival timing on the basis of the final release timing and the arrival timing which are outputted from the running state detection circuit 60*a*. The operation circuit 66 also calculates a total value due to the leading end troubles, blow-by at the leading ends and barrel slippings, that is, a total stopping machine frequency, a sum of the total individual cause stopping machine frequency, that is, a whole stopping machine frequency, and a ratio s of the total stopping machine frequency to the whole stopping machine frequency on the basis of an individual cause stopping machine signal which is outputted from the stopping machine cause detection circuit 60*b*. Furthermore, the operation circuit 66 calculates a slack filling frequency y on the basis of a slack filling signal which is outputted from a fabric quality detection circuit 60*c*, and further calculates a pick number (weft inserting frequency) on the basis of a detection signal which is outputted from the pick detection circuit 60*d*.

By substituting the values of $\mu k$, $\mu k0$, $\sigma k$, $\sigma k0$, $\mu t$, $\mu t0$, $\sigma t$, $\sigma t0$, y and s into the preceding approximate expression every time when each pick number reaches a set value in the setting circuit 64, the operation circuit 66 calculates a corrected content $\Delta M$ of the main pressure and adds the calculated corrected content to the present main pressure to thereby give a new main pressure.

The operation circuit 66 provides the calculated main pressure in a pressure controller 68 as it is in a form of a new main pressure in case where the new main pressure is within the upper and lower limit values set in the setting circuit 64, while the operation circuit 66 provides a limiting value in the pressure controller 68 as a new main pressure in case where the calculated main pressure is at the outside of the upper and lower limit values.

Accordingly, the pressure controller 68 adjusts the main pressure into a new value. As a result, the weft inserting is made so that satisfy any of the running state, stopping state of the weaving machine and fabric quality thereof. The preceding process is carried out for each predetermined pick number (or each certain period of time.)

The preceding approximate expression may be calculated each kind of thread. Each coefficient for each kind of thread is defined as follows:

| | |
|---|---|
| filament yarn: 1, | acetate yarn: 2, |
| finished yarn: 3, | glass yarn: 4 and |
| span yarn: 5, | |

and these coefficients may be incorporated into the approximate expression.

According to the control method by use of the preceding approximate expression, the storage capacity of the memory circuit becomes remarkably small.

Figure 2:
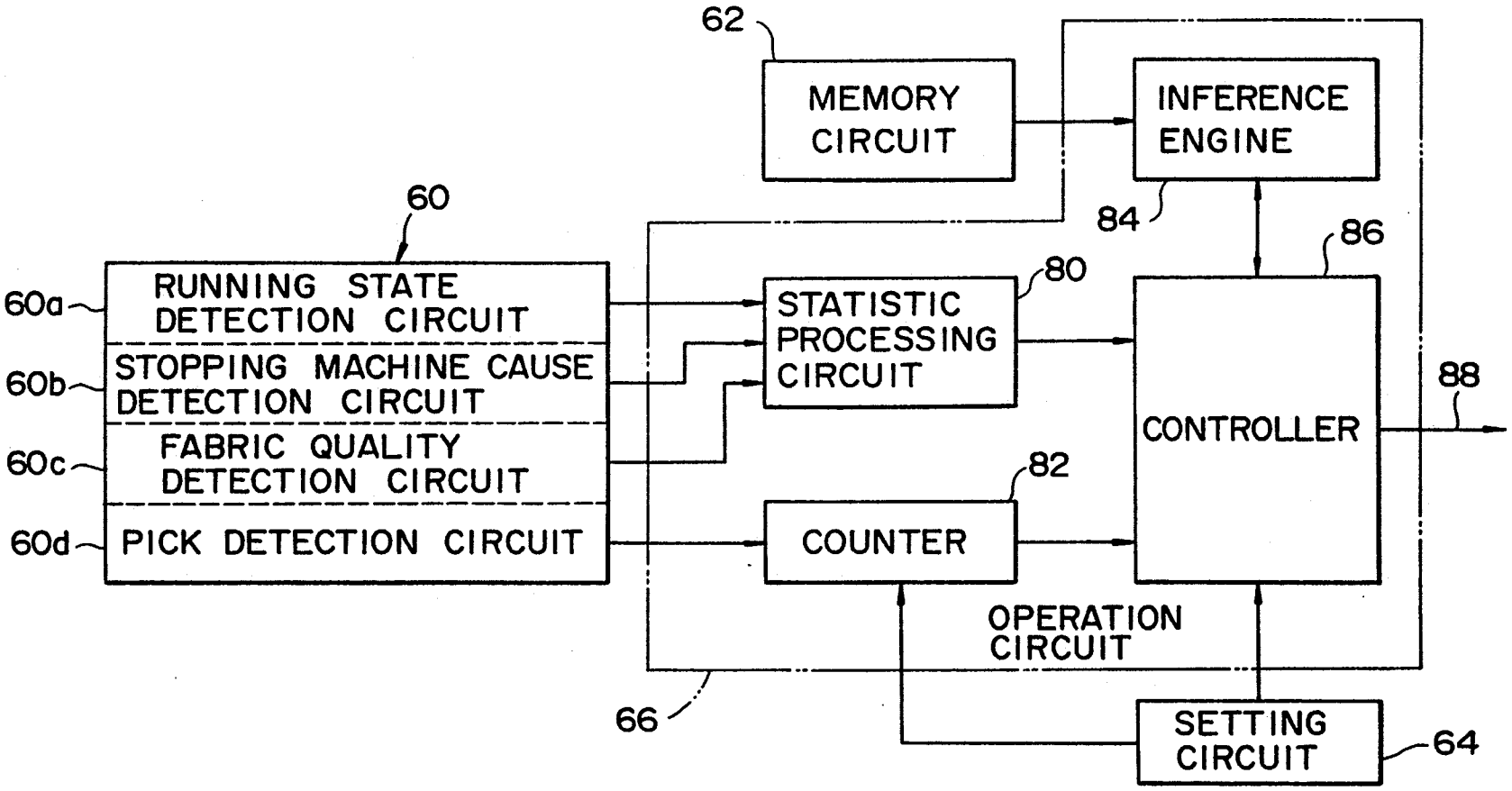
FIG. 2 is a block diagram showing an electric circuit of a weft inserting control apparatus as another embodiment of the present invention.

Referring now to FIG. 2, the detailed description of a method for controlling weft inserting by use of the expert system will be given in the following.

The operation circuit 66 comprises a circuit 80 for statistically processing the output signals received from the running state detection circuit 60*a*, the stopping machine cause detection circuit 60*b* and the fabric quality detection circuit 60*c*, a counter 82 for counting the output signal from the pick detection circuit 60*d* until the output signal becomes equal to the value set in the setting circuit 64, an inference engine 84 for inferring correction values for control conditions on the basis of a plurality of control rules stored in the memory circuit 62, and a controller 86 for calculating renewed control conditions on the basis of the output signals from the circuits 64, 80, 82, and 84.

An embodiment of the control rules R1 through R9 in case of setting the control condition as the main pressure will be shown in the following. The control rules R′, R″ and R1 through R9 correspond to the control algorithms A1 through A9, respectively.

R′: If any leading end troubles, blow-by at the leading ends and barrel slippings happen a little, then $s=0$, and otherwise $s=1$.

R″ "If any leading end troubles, blow-by at the leading ends and barrel slippings previously happened a little, then $s'=0$, and otherwise $s'=1$.

| | |
|---|---|
| R1: | If $y>0$, then $\Delta M=+p$. |
| R2: | If $y=0$, $s=1$ and $y'>0$, then $\Delta M=0$. |
| R3: | If $y=0$, $s=1$ and $y'=0$, then $\Delta M=p$. |
| R4: | If $y=0$, $s=0$ and beside $y'>0$ or $s'=0$, then $\Delta M=0$. |
| R5: | If $y=0$, $s=0$, $y'=0$, $s'=0$ and besides $\mu k>\mu k0$ or $\sigma k>\sigma k0$, then $\Delta M=+p$. |
| R6: | If $y=0$, $s=0$, $y'=0$, $s'=0$, $\mu k<\mu k0$, and $\sigma k<\sigma k0$, besides $\mu t>\mu t0$ and $\sigma t>\sigma t0$, then $\Delta=+p$. |
| R7: | If $y=0$, $s=0$, $y'-0$, $s'=0$, $\mu k<\mu k0$, and $\sigma k<\sigma k0$, besides $\mu t>\mu t0$ and $\sigma t<\sigma t0$, then $\Delta M=+p$. |
| R8: | If $y=0$, $s=0$, $y'=0$, $s'=0$, $\mu k<\mu k0$, and $\sigma k<\sigma k0$, besides $\mu t<\mu t0$ and $\sigma t>\sigma t0$, then $\Delta M=0$. |
| R9: | If $y=0$, $s=0$, $y'=0$, $s'=0$, $\mu k<\mu k0$, and $\sigma k<\sigma k0$, besides $\mu t<\mu t0$ and $\sigma t<\sigma t0$, then $\Delta M=-p$. |

In the preceding control rules R1 through R9, the symbols indicate as follows:

$\mu k$: an average value of final release time, $\sigma k$: a dispersion (amount of scatter) of final release timing, $\mu t$: an average value of arrival timing, $\sigma t$: a dispersion of arrival timing, $\sigma k0$: a threshold in the average value of final release timing, $\mu k0$: a threshold in the dispersion of final release timing, $\mu t0$: a threshold in the average value of arrival timing, $\sigma t0$: a threshold in the dispersion of arrival timing, y: a present slack filling frequency, y′: a previous slack filling frequency, $\Delta M$: a corrected value for the main pressure, p: a variation quantity in the main pressure preliminarily given, s: a ratio of a total stopping machine frequency due to the leading end troubles, blow-by at the leading ends and barrel slippings to a present whole stopping machine frequency, and s': a ratio of a total stopping machine frequency due to the leading end troubles, blow-by at the leading ends and barrel slippings to a previous whole stopping machine frequency.

The average value $\mu K$ and the dispersion $\sigma k$ of the final release timing and the average value $\mu t$ and the dispersion $\sigma t$ of arrival timing in the preceding control rules R1 through R9 are calculated in the statistical processing circuit 80 on the basis of the final release timing and arrival timing which are generated from the running state detection circuit 60*a*, respectively.

Also, the total stopping machine frequency due to the leading troubles, blow-by at the leading ends and barrel slippings, the whole stopping machine frequency, the ratio s of the total stopping machine frequency to the present whole stopping machine frequency and the ratio s' of the total stopping machine frequency to the previous whole stopping machine frequency, respectively, are calculated in the statistical processing circuit 80 on the basis of the individual cause stopping machine signals generated from the stopping machine cause detection circuit 60*b*. Furthermore, the present slack filling frequency y and the previous slack filling frequency y' are calculated in the statistical processing circuit 80 on the basis of the slack filling signals generated from the fabric quality detection circuit 60*c*.

The threshold $\mu k0$ in the average value of final release timing, the threshold $\sigma k0$ in the dispersion of final release timing, the threshold $\mu t0$ in the average value of arrival timing, the threshold $\sigma t0$ in the main dispersion of arrival timing, and the variation p of the main pressure respectively, are preliminarily set in the setting circuit 64. These various thresholds can be used which are the same as various objective values used in the preceding embodiment on the basis of the previous approximate expression.

Whenever the output value from the counter 82 becomes equal to the previously set value in the setting circuit 64, the controller 86 receives the data from the statistical processing circuit 80 and provides the received data to the inference engine 84, together with the right of execution. Then, the inference engine 84 infers the corrected value $\Delta M$ of the main pressure on the basis of the received data, and the control rules R', R'' and R1 through R9 to provide a resultant corrected value $\Delta M$ to the controller 86.

The controller 86 calculates a renewed present value for the main pressure by adding the corrected value $\Delta M$ thus inferred to the present main pressure value. If the resultant value for the main pressure is within the upper and lower limit values, then the controller 86 provides the resultant value as a renewed present value for the main pressure through a line 88 to the pressure controller 68 in FIG. 1. If the resultant value for the main pressure is at the outside of the upper and lower limit values, then the limiting value is provided as a renewed value for the main pressure to the pressure controller 68 through the line 88.

Now, the pressure controller 68 adjusts the main pressure to the renewed value, and as a result, the weft inserting can be performed under a condition satisfactory to any of the running state of the weft, the stopping state of the weaving machine and the fabric quality. The preceding process in this case is carried out each predetermined pick number (or each certain period of time).

In this preferred embodiment, the main pressure itself to be altered is to be determined on the basis of the control algorithms A1 through A9 in a combination with the running information, stopping machine information and quality information. Instead of these algorithms, use may be made of the control algorithms A10 through A13 for correcting the objective value used in the automatic control system on the basis of the running information.

Figure 3:
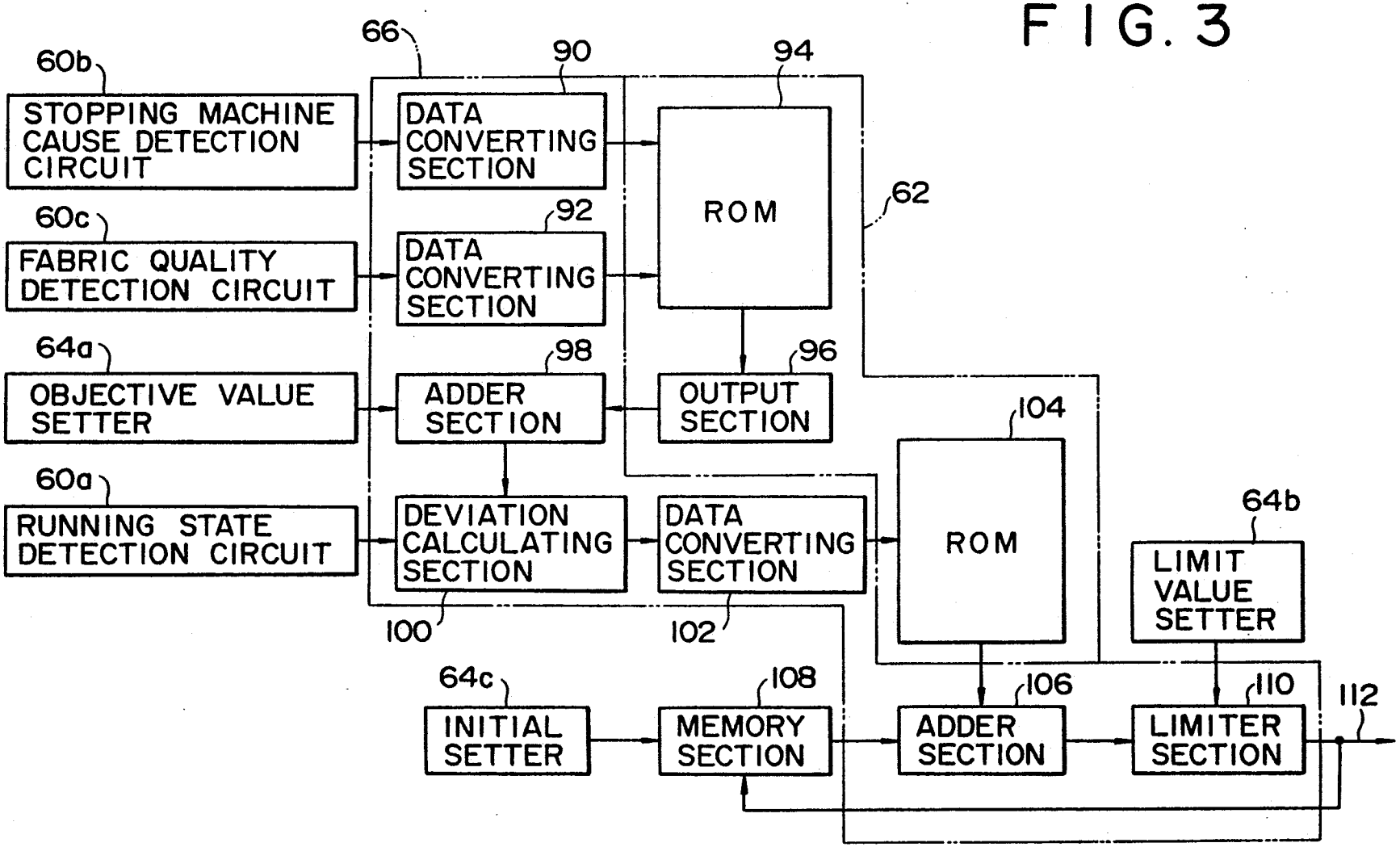
FIG. 3 is a block diagram showing an electric circuit of a weft inserting control apparatus as a further embodiment of the present invention.

Referring now to FIGS. 3, 4(A) and 4(B), a method for controlling weft inserting by use of the data table will be explained in the following. This preferred embodiment is based on the preceding control algorithms A10 through A13, adopts what can correct the main pressure so that various running timing may be accommodated within the objective values as the automatic control system on the basis of the running information, and corrects the objective values to be used in this automatic control system on the basis of the stopping machine information and the quality information.

The output signals from the stopping machine cause detection circuit 60*b* and the fabric quality detection circuit 60*c* are provided to data converting sections 90 and 92 within the operation circuit 66. On the basis of the individual cause stopping machine signal generated from the stopping machine cause detection circuit 60*b*, the data converting section 90 calculates both the total stopping machine frequency due to the leading end troubles, blow-by at the leading ends and barrel slippings and the whole stopping machine frequency to obtain the ratio s of the total stopping machine frequency to the whole stopping machine frequency, and provides the value thus obtained to a Read Only Memory, that is, a ROM 94 in the memory circuit 62. On the other hand, the data converting section 92 calculates the slack filling frequency y on the basis of the slack filling signals received from the fabric quality detection circuit 60*c* to provide the calculated value y to the ROM 94.

The ROM 94 stores the following data each combination of the slack filling frequency y and the ratio s of the total stopping machine frequency to the whole stopping machine frequency as a table shown in FIG. 4(A) according to the preceding control algorithms A10 through A13;

a corrected value $\Delta\mu k0$ of the objective value in the average value of final release timing;

a corrected value $\Delta\sigma k0$ of the objective value in the dispersion of final release timing;

a corrected value $\Delta\mu t0$ of the objective value in the average value of arrival timing; and a corrected value $\Delta\sigma t0$ of the objective value in the dispersion of arrival timing.

Also, the ROM 94 receives the slack filling frequency y and the ratio s as address signals and then provides the corrected values $\Delta\mu k0$, $\Delta\sigma k0$, $\Delta\mu t0$, and $\Delta\sigma t0$ corresponding to the received address signals through an output section 96 to an adder section 98 in the operation circuit 66.

The adder circuit 98 adds the corrected values $\Delta\mu k0$, $\Delta\sigma k0$, $\Delta\mu t0$, and $\Delta\sigma t0$ to the corresponding objective values set in an objective value setter 64*a* of the setting circuit to calculate new objective values $\mu k0$, $\sigma k0$, $\mu t0$, and $\sigma t0$, respectively. Then, the adder circuit 98 provides the calculated objective values to a deviation calculating section 100 in the operation circuit 66.

The deviation calculating section 100 calculates the average values $\mu k$ and $\mu t$ and the dispersion $\sigma k$ and $\sigma t$ of the corresponding timing on the basis of the final release timing and arrival timing which are provided from the running state detection, circuit 60*a*, and then calculates the deviations of the calculated values from the corresponding objective values $\mu k0$, $\sigma k0$, $\mu t0$ and $\sigma t0$ supplied from the adder section 98. Then, the deviation calculating section 100 provides the deviations thus obtained to the Read Only Memory, that is ROM 104 in the memory circuit 62 through a data converting section 102 in operation circuit 66.

The ROM 104 stores the variation $\Delta M$ of the main pressure as a table shown in FIG. 4(B), for each combination of actual values, that is, a deviation ($\mu k-\mu k0$) in the average value of final release timing;

a deviation ($\sigma k-\sigma k0$) in the dispersion of final release timing;

a deviation ($\mu t-\mu t0$) in the average value of arrival timing; and a deviation ($\sigma t-\sigma t0$) in the dispersion of arrival timing.

In addition, the ROM 104 receives the preceding deviations as a address signal and outputs the variation $\Delta M$ corresponding to the received address signal to an adder section 106 in the operation circuit 66.

The adder section 106 adds the variation $\Delta M$ supplied from the ROM 104 to the present main pressure M supplied from a memory section 108 and then provides the added value to a limiter section 110 in the operation circuit 66.

When the main pressure supplied from the adder section 106 is within the upper and lower limit values set in a limiting value setter 64*b* in the setting circuit, the limiter section 110 provides the main pressure from the adder section 106 to the pressure controller 68 in FIG. 1 through a line 112 as a new main pressure. The limiter section 110, however, outputs the upper limit value in a case where the main pressure from the adder section 106 exceeds the upper limit value and the lower limit value in a case where the preceding main pressure does not reach the lower limit value to the line 112 as a new main pressure, respectively.

Accordingly, the pressure controller 68 adjusts the main pressure into a new value. As a result, weft inserting is carried out so as to satisfy any of the weft running state, the stopping state of the weaving machine and the fabric quality. The preceding process is also carried out for each predetermined pick number (or each certain period of time).

The new main pressure in the line 112 is stored in the memory section 108 so as to be used as a present main pressure in the subsequent correction process. An objective value set in an initial setter 64*c* of the setting circuit 64 is stored in the memory section 108 at the initiation of the operation for the apparatus for controlling weft inserting.

The table shown in FIG. 4 is one of the embodiments, and the tables of the ROM 94 and ROM 104 are preferably subdivided within a permissible range of the memory capacity thereof.

Incidentally, this preferred embodiment is based on the control algorithms A10 through A13 for correcting the objective value to be used in the automatic control system on the basis of the running information. Instead of this, it may be based on the control algorithms A1 through A9 in combination with the running information, stopping machine information and quality information in a manner similar to the preceding embodiment.

What is claimed is:

1. A method for controlling an actuator for weft inserting in a jet loom, comprising the steps of:

generating at least two kinds of information including both first information and second information, the first information consisting of running information representing the running state of a weft, and the second information consisting of stopping machine information representing the stopping state of a weaving machine or quality information representing the state of a woven fabric quality;

obtaining an actuator control condition of the actuator by utilizing a control condition-generating means, on the basis of said at least two kinds of information; and controlling the actuator on the basis of an obtained actuator control condition;

said control condition-generating means being at least one selected from the group consisting of:

a) an expert system including control algorithms for weft inserting for obtaining said actuator control condition;

b) operating means provided with a data table having data for weft inserting, said data being composed according to control rules for weft inserting, and said operating means obtaining said actuator control condition on the basis of said at least two kinds of information and said data; and c) calculating means provided with memory means which stores a plurality of approximate expressions for calculating said actuator control condition by using said at least two kinds of information, said calculating means obtaining said actuator control condition by using said at least two kinds of information and said approximate expressions.

2. A method according to claim 1, wherein said control condition-generating means is said expert system.

3. A method according to claim 1, wherein said control condition-generating means is said operating means.

4. A method according to claim 1, wherein said control condition-generating means is said calculating means.

5. An apparatus for controlling an actuator for weft inserting in a jet loom, comprising:

information-generating means for generating at least two kinds of information including both first information and second information, the first information consisting of running information representing the running state of a weft, and the second information consisting of stopping machine information representing the stopping state of a weaving machine or quality information representing the state of a woven fabric quality, control condition-generating means for obtaining an actuator control condition for weft inserting on the basis of said at least two kinds of information, and means for controlling the actuator on the basis of the obtained actuator control condition, said control condition generating means being at least one means selected from the group consisting of:

a) an expert system including control algorithms for weft inserting for obtaining said actuator control condition;

b) operating means provided with a data table having data for weft inserting, said data being composed according to control rules for weft inserting, and said operating means obtaining said actuator control condition on the basis of said at least two kinds of information and said data; and c) calculating means provided with memory means which stores a plurality of approximate expressions for calculating said actuator control condition by using said at least two kinds of information, and said calculating means obtaining said actuator control condition by using said at least two kinds of information and said approximate expressions.

6. An apparatus according to claim 5, wherein said control condition-generating means is said expert system.

7. An apparatus according to claim 5, wherein said control condition-generating means is said operating means.

8. An apparatus according to claim 5, wherein said control condition-generating means is said calculating means.

* * * * *